US006454669B1

(12) United States Patent
James

(10) Patent No.: US 6,454,669 B1
(45) Date of Patent: Sep. 24, 2002

(54) ANNULUS GOLF TEE WITH REMOVABLE PENETRATION CONE

(76) Inventor: Rose T. James, P.O. Box 1504, Ormond Beach, FL (US) 32175

( * ) Notice: Subject to any disclaimer, the term of this patent is extended or adjusted under 35 U.S.C. 154(b) by 0 days.

(21) Appl. No.: 09/782,200

(22) Filed: Feb. 14, 2001

(51) Int. Cl.[7] ..... A63B 57/00
(52) U.S. Cl. ..... 473/400; 473/387
(58) Field of Search ..... 473/387–403, 473/386; D21/717, 718

(56) References Cited

U.S. PATENT DOCUMENTS

| | | | | |
|---|---|---|---|---|
| 1,638,527 | A | | 8/1927 | Clausing |
| 1,644,979 | A | | 10/1927 | Clausing |
| 1,644,980 | A | | 10/1927 | Clausing |
| 1,656,401 | A | | 1/1928 | Totten |
| 1,759,657 | A | | 5/1930 | McLeod |
| 2,011,203 | A | * | 8/1935 | Seiki ..... 473/396 |
| 2,074,519 | A | | 3/1937 | Shephard |
| 2,128,049 | A | | 8/1938 | Karkoska |
| 2,455,705 | A | | 12/1948 | Seager |
| 2,722,062 | A | | 11/1955 | Phillips |
| 2,739,812 | A | | 3/1956 | Daniels |
| 2,801,852 | A | | 8/1957 | Hottle |
| 2,950,110 | A | | 8/1960 | Slotta |
| 3,220,727 | A | | 11/1965 | Legan |
| 3,351,258 | A | | 11/1967 | Evantash |
| 3,516,664 | A | | 6/1970 | Brennan |
| 3,540,727 | A | | 11/1970 | Hoe, Jr. |
| 3,559,998 | A | | 2/1971 | Kelly et al. |
| 3,633,919 | A | | 1/1972 | Liccardello |
| 3,671,036 | A | | 6/1972 | Rubino |
| 3,697,082 | A | | 10/1972 | Di Laura et al. |
| 3,747,927 | A | | 7/1973 | Hoffman |
| 4,090,298 | A | | 5/1978 | Rushforth |
| 4,103,888 | A | | 8/1978 | Ricketts |
| 4,181,300 | A | | 1/1980 | Bradley |
| 4,277,892 | A | | 7/1981 | Rushforth |
| 4,418,909 | A | * | 12/1983 | Messana ..... 473/396 |
| 4,783,077 | A | | 11/1988 | Lemon |
| 4,893,818 | A | * | 1/1990 | Liccardello ..... 473/396 |
| 4,896,883 | A | | 1/1990 | Wagenknecht |
| 4,948,130 | A | * | 8/1990 | Rydborn ..... 473/391 |
| 4,951,947 | A | | 8/1990 | Kopfle |
| 4,989,869 | A | | 2/1991 | Lackey |
| 4,998,732 | A | | 3/1991 | Gallant |
| 5,052,689 | A | | 10/1991 | Lettrich |
| 5,154,417 | A | | 10/1992 | Kohli |
| 5,505,444 | A | | 4/1996 | Bouclin, Jr. |
| 5,540,433 | A | | 7/1996 | Engstrom |
| 5,718,646 | A | | 2/1998 | Brewer |
| 5,738,598 | A | | 4/1998 | Wu |
| 5,743,819 | A | | 4/1998 | Chun |
| 5,759,117 | A | | 6/1998 | Erickson, Jr. |
| 5,759,118 | A | * | 6/1998 | Sroczynski ..... 473/387 |
| 5,772,533 | A | | 6/1998 | Dahlmann |
| 5,885,174 | A | | 3/1999 | Barnes |
| 5,913,737 | A | | 6/1999 | Park |
| 5,967,909 | A | | 10/1999 | Broadbridge |
| 6,010,413 | A | | 1/2000 | Pan-Chung |
| 6,053,821 | A | | 4/2000 | Palmer |
| 6,053,822 | A | | 4/2000 | Kolodney |
| 6,062,990 | A | | 5/2000 | Pierce |
| 6,224,501 | B1 | * | 5/2001 | Rudduck et al. ..... 473/401 |

* cited by examiner

*Primary Examiner*—Steven Wong

(57) ABSTRACT

A dime-sized annulus top end is provided for a golf tee. Also provided for the golf tee is a removable penetration cone which is a piece of stiff material with a pointed end for inserting into ground and an open hollowed end for receiving and securely holding a golf tee point. The annulus rim golf tee and removable penetration cone, while simple and unobtrusive, stabilize a teed golf ball, reduce re-teeing, and provide easy tee-insertion into all terrain.

1 Claim, 1 Drawing Sheet

ANNULUS GOLF TEE WITH REMOVABLE PENETRATION CONE

FIELD OF THE INVENTION

This invention relates to golf tees.

BACKGROUND OF THE INVENTION

In the sport of golf, the opening shot of each hole is hit with the golf ball resting on a tee. Golf tees have been the subject of much work for some years, see, e.g., U.S. Pat. Nos. 6,062,990; 6,053,822; 6,010,413; 5,738,598; 5,759,118; 5,505,444; 5,154,417; 4,998,732; 4,989,869; 4,783,077; 4,181,300; 4,103,888; 3,747,927; 3,697,082, even back to the 1920s, see, e.g., U.S. Pat. Nos. 1,759,657; 1,656,401; 1,644,979; 1,644,980; 1,638,527. Forcing tees into the ground also has been considered, see, e.g., U.S. Pat. Nos. 5,913,737; 5,540,433; 5,718,646; 4,896,883; 4,277,892; 4,090,298; 3,671,036; 3,540,727; 3,220,727; 2,801,852; 2,722,062.

Golf tees generally are about 2 inches long and of a unitary piece of wood. Known golf tees support the golf ball so that the ball may be struck, but without maximally balancing and supporting the golf ball. Sometimes the ball rolls off the tee. When a ball that is not well-balanced on the tee is struck, the ball's flight is less than optimal. For example, the ball could have traveled a longer distance if well-balanced on the tee. Also, when a golfer cannot count on the ball being well-balanced consistently on the tee, it may be difficult to hit with confidence. Relatedly, problems with "slicing" into the ball may be related to the teed ball not being well balanced.

Thus, reliably supporting the golf ball in the most stable manner possible is an important objective for a golfer, and a tee that provides maximal stability is needed. Such a tee desirably should be simple to manufacture, have no extra parts compared to a current tee, and be unobtrusive and unremarkable in appearance.

Another aspect of teeing in golf is that with known golf tees, balls often fall off and require re-teeing, and the need to re-tee the ball can result in unnecessary bending over. Such further bending can be especially problematic and unpleasant for golfers hindered by arthritis and back problems. As there is a high desire among golfers to continue golfing even as arthritis or back problems arise, simple methods for reducing re-teeing without requiring contraptions or complicated devices are especially needed.

A golf tee has two ends, a ball-holding end and a pointed end for inserting into the ground. Both ends of known golf tees may be susceptible of improvement.

As to the ball-holding end of a golf tee, various modifications have been suggested. See, e.g., U.S. Pat. No. 5,505,444 to Bouclin, Jr. (1996); U.S. Pat. No. 5,759,118 to Sroczynski (1998); U.S. Pat. No. 6,053,822 to Kolodney et al. (2000). However, the ball-holding end of golf tees still needs improvement for better holding the ball in a maximally stable position, by a tee that at the same time it provides maximal stability still also is of a simple structure.

The ground-breaking end of standard wood golf tees is not well-suited for certain terrain. For example, a conventional wood tee wobbles when inserted into rocky mountain or sandy beach terrain. Inserting a standard golf tee into dry, hard, frozen or sandy turf is not easy.

One adaptation of a standard golf tee is used by Chi Chi Rodrigues, namely, what is believed to be a golf tee of generally standard construction but with an extended-length ground-breaking end. Such an extended-length golf tee still can be improved, such as with respect to positioning the golf ball on the ball-holding end, and still leaves to be addressed the problem of insertion of the tee into difficult terrain. Additionally, a way is needed to achieve gains in stability while maintaining an inconspicuous, more standard tee appearance.

Also, the need for properly supporting a golf ball on a tee is recognized in U.S. Pat. No. 5,967,909 to Broadbridge (1999) but this relatively complex device is for a driving range and does not address the problem of stabilizing the golf ball tee during actual play on the golf course. Although some golf tee setting or supporting devices are known (U.S. Pat. No. 5,913,737 to Park (1999); U.S. Pat. No. 052,689 to Lettrich (1991)), there remains a need for simpler methods of stabilizing golf tees and setting golf balls with improved stability.

The need to facilitate tee-insertion has been recognized in U.S. Pat. Nos. 4,277,892 and 4,090,298 (to Rushforth); however, the need for a simple solution to the problem of teeing in difficult terrain remains.

SUMMARY OF THE INVENTION

With the view that the challenge of the game of golf should not be to keep the ball on the tee, and after much evaluation by the inventor of potential ways to maximally balance the ball on the tee, the present inventor arrived at the following inventive products, including golf tees, golf tee penetration cones and golf tee kits.

The invention provides a golf tee comprising a tee having a ball-holding top end that is a dime-sized annulus (a dime being about 18 mm in diameter). In a preferred embodiment, the tee is made of wood.

The invention also provides a removable penetration cone for a golf tee, comprising a piece of stiff material having a pointed end for inserting into the ground and an open hollowed end for receiving and securely holding a golf tee point.

In a preferred embodiment, the inventive cone has an approximate end-to-end length of 1½ inches.

In an especially preferred embodiment, the cone's stiff material is wrapped tin.

In another preferred embodiment, the cone's stiff material is plastic.

The invention also provides a golf tee kit, comprising a wood tee having a ball-holding top end that is a dime-sized annulus; and a removable penetration cone for a golf tee, comprising a piece of stiff material having a pointed end for inserting into ground and an open hollowed end for receiving and securely holding a golf tee point.

In another embo nt, the invention provides a method of reducing golf ball reteeing, comprising inserting into terrain a tee having a ball-holding top end that is a dime-sized annulus; wherein, before the inserting step, the tee optionally is slipped into a removable penetration cone comprising a piece of stiff material having a pointed end for inserting into ground and an open hollowed end for receiving and securely holding a golf tee point.

SUMMARY OF THE DRAWINGS

FIG. 6 is an elevational view of a tee according to the invention being inserted into a penetration cone according to the invention (of which FIG. 3 is the unformed cone).

DETAILED DESCRIPTION OF THE PREFERRED EMBODIMENTS

Figure 1:
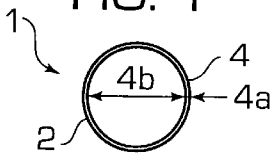
FIG. 1 is a top view of a golf tee with an annulus rim according to the invention.
Figure 2:
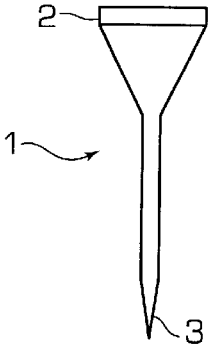
FIG. 2 is an elevational view of the golf tee of FIG. 1.

As shown in FIGS. 1 and 2, in one embodiment a tapered wood golf tee 1 according to the invention is about 2 inches in length from the ball-holding end 2 to the ground-breaking end 3. The tee 1 preferably is formed by carving one piece of wood, on a wood lathe. (Alternately, a hand-carved version of a tee, such as a sample before production scale-up, may be made in two pieces.) The tee 1 is a slim version, so as not to be cumbersome in a golfer's pocket and so as to be easily handled.

At the ball-holding end 2 is an annulus rim 4 that is dime-sized in circumference. The diameter 4*b* of the annulus rim 4 is such that the rim is about dime-sized. The dime-sized circumference has been found to be critical for positioning a golf ball with maximal stability. The thickness 4*a* of the annulus rim 4 is about ⅛ inch. The rim thickness is not particularly important. The ball-holding end 2 of the tee 1 is concave, for receiving and holding a golf ball. The ball sits perfectly on the annulus 4.

The dime-sized annulus rim 4 is a unitary part of the tee 1. When the tee 1 is made of wood, whittling or other methods known in the art for manufacturing wood tees may be used to make the tee.

Most preferably, the concavity or curvature of the annulus rim 4 is such that with the golf ball resting therein the golf ball surface is in maximal direct contact with the interior of the annulus rim. The curvature is such that the ball and annulus rim interior are freely in contact, that is, the ball is not wedged into the annulus rim interior. The concavity of the annulus rim tracks the curvature of a golf ball to be placed therein.

Figure 3:
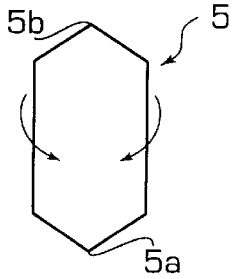
FIG. 3 is an elevational view of a metal sheet that is an unformed penetration cone according to the invention.
Figure 6:
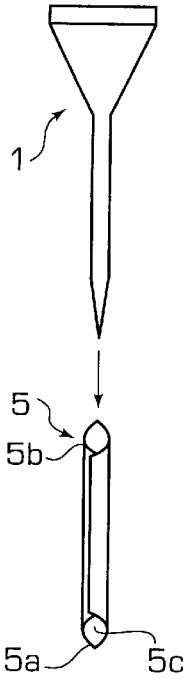
Figure 7:
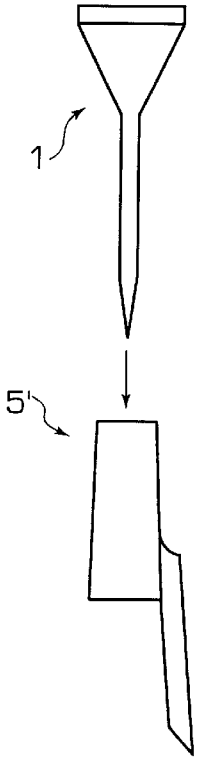
FIG. 7 is an elevational view of a tee according to the invention being inserted in a penetration cone according to the invention (also shown in FIG. 4).
Figure 8:
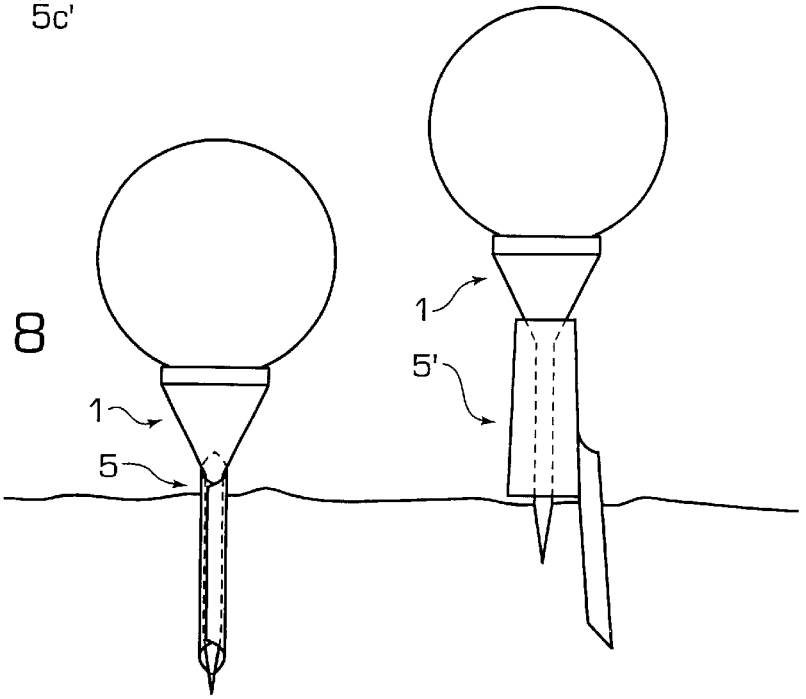
FIG. 8 is an elevational view of an annulus rim golf tee according to the invention (also shown in FIGS. 1, 2, 6 and 7) and two different removable penetration cones according to the invention (also shown in FIGS. 6 and 7, respectively), with a golf ball sitting on each tee, with the tee inserted into the penetration cone and the combination tee/penetration cone inserted into the ground.

A removable metal penetration cone 5 of approximate 1½ inch length from ground end 5*a* to top end 5*b* is shown in FIGS. 3, 6 and 8. 5 The tee 1 optionally, at a golfer's discretion as teeing up at a particular hole, fits into the removable penetration cone 5 to use on dry, hard, frozen and sandy turf.

Penetration cone 5 may be formed by wrapping a piece of tin or plastic into a cone. The tin used in a preferred embodiment is ordinary flashing tin, or gardening tin, available at a gardening supply shop as often used for surrounding flower beds. A light weight tin is used for easy folding. Tin foil (the kitchen product) is too lightweight.

An example of a not-yet-folded piece of tin from which to make a cone of FIG. 6 is shown in FIG. 3. The unfolded tin piece is a hexagonal shape, with facing parallel sides of about 1 inch in length (separated by about ¾ inches) and with the other four sides each about ½ inch long. From point to point, the unfolded tin piece is about 1½ inch long. The tin is wrapped into a cone shape, and no rivets are needed. When the 1-inch ends are wrapped together, slightly overlapping the ¾ inch width, the wrapped cone ideally fits the tee insertion.

As seen in FIG. 6, the top end 5*b* of the cone 5 must be of sufficiently large diameter for receiving a tee. The ground end 5*a* of the cone 5 may, but is not necessarily required to, be open. That is, the hollowed opening 5*c* within the cone 5 begins at top end 5*b* and in a preferred embodiment extends all the way to ground end 5*c* as in FIG. 8, but the hollow opening 5*c* is not necessarily required to traverse the length of the cone 5. The hollow opening 5*c* is of diameter such that the tee 1 can be received and gripped. That is, the diameter of the hollow opening 5*c* cannot be too large that the tee wobbles in the cone 5, and the diameter of the hollow opening 5*c* also cannot be too small or else the tee cannot be inserted therein.

Most preferably, the inserted golf tee point is contained, and does not protrude from, the cone 5, so that it is the ground-breaking end 5*a* of the cone 5 that penetrates the ground.

Figure 4:
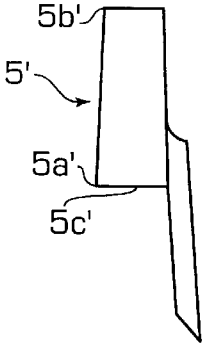
FIG. 4 is an elevational view of a plastic penetration cone, which is a different embodiment than FIG. 3.
Figure 5:
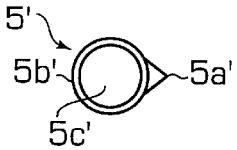
FIG. 5 is a top view of the plastic penetration cone of FIG. 4.

In another embodiment, a penetration cone 5' is made by modifying a plastic pen covering cap, as in FIGS. 4 and 8, by hacking off the top, enclosed part of the covering cap 5*b*', to make an opening 5*c*' for inserting a tee. The tee is pushed into the opening 5*c*' in the plastic covering cap so that the ball end 2 of the tee 1 protrudes above the cap and the ground end of the tee protrudes slightly in the other opening. The plastic end 5*a*' of the pen covering cap that would be used for attaching a pen to a person's pocket is used to insert into the ground.

It will be appreciated that a removable penetration cone according to the present invention may, but is not required to, be used with an annulus rim tee according to the present invention. The inventive annulus rim tee and the removable penetration cone each may be used independently of the other, or with each other.

Another way of making a cone (not shown) according to the invention may be to start from a solid cone and to drill or otherwise make therein a hollow opening traversing all or a sufficient part of the length of the solid cone.

The invention maximally balances a ball on a golf tee, to create perfect balance, so that the ball will travel greater distance in flight than otherwise.

When a golf ball sits on the annulus of dime-size circumstance provided by this invention, superb stability is provided in that the proper amount of golf ball surface is covered to balance the golf ball maximally. The player is therefore able to hit exactly under the ball every time without hesitation or doubt, therefore avoiding "slicing" into it. Dents and slices in the ball—which minimize its potential and prevent travelling the maximum distance—can be avoided.

The removable penetration cone according to the invention keeps the tee stable in any type of ground surface, including rocky mountain, sandy beach or anything in between. The invention facilitates teeing off in conditions that otherwise would have been difficult or impossible.

Further, the invention makes the game more pleasant for both amateur and professional golfers alike by eliminating unnecessary bending-over the reduction of which is a great advance to those golfers hindered by arthritis and back problems.

The annulus rim golf tee and removable penetration cone of the present invention—while simple and unobtrusive—stabilize a teed golf ball and promote maximal travel by the ball, reduce re-teeing, and provide easy tee-insertion into all terrain.

It will be appreciated that the inventive methods and golf tees described herein may be modified in various ways without departing from the spirit of the invention.

It will be appreciated that the above information is not intended to be limiting and that modifications may be made without departing from the spirit of the invention.

What is claimed is:

1. A golf tee kit, consisting essentially of:

(A) a wood tee having a ball-holding top end that is a dime-sized annulus rim, wherein the annulus rim is about ⅛ inch thickness, the annulus rim being a unitary part of the wood tee, the annulus rim having an interior, and wherein the ball-holding end is concave having a concavity providing maximal direct contact between the interior of the annulus rim and a golf ball positioned on the tee; and (B) a removable penetration cone for a golf tee, comprising a piece of stiff material having a pointed end for inserting into ground and an open hollowed end for receiving and securely holding a golf tee point, the tee being insertable into the penetration cone.

* * * * *